United States Patent [19]

Bender

[11] Patent Number: 4,655,695

[45] Date of Patent: Apr. 7, 1987

[54] ROTATING FLUID DRIVEN ROTARY ACTUATOR

[76] Inventor: Friedrich K. Bender, 14557 Chere Dr., Whittier, Calif. 90604

[21] Appl. No.: 718,647

[22] Filed: Apr. 1, 1985

[51] Int. Cl.[4] ..... F01C 1/063; F03C 2/02

[52] U.S. Cl. ..... 418/34; 418/35

[58] Field of Search ..... 418/33–35

[56] References Cited

U.S. PATENT DOCUMENTS

| | | | |
|---|---|---|---|
| 150,350 | 4/1874 | Palmer | 418/34 |
| 569,408 | 10/1896 | Chaboche | 418/34 |
| 706,730 | 8/1902 | Dupont | 418/34 |
| 4,359,980 | 11/1982 | Somraty | 418/34 |

FOREIGN PATENT DOCUMENTS

| | | | |
|---|---|---|---|
| 4517 | of 1820 | United Kingdom | 418/34 |
| 1059219 | 12/1983 | U.S.S.R. | 418/35 |

*Primary Examiner*—John J. Vrablik

*Attorney, Agent, or Firm*—Edgar W. Averill, Jr.

[57] ABSTRACT

A substantially continuously rotating fluid driven rotary actuator. The actuator provides a rotary output in one direction. The turning force is generated by the opposite motion of a vane within a partitioned chamber. Rotary movement is controlled in the desired direction by four one-way bearings. A rotating valve directs the fluid into and out of a pair of chambers within a rotating cylinder. The device may be driven by any fluid including a liquid, a gas or a combustible gas mixture.

8 Claims, 8 Drawing Figures

FIG. 1.
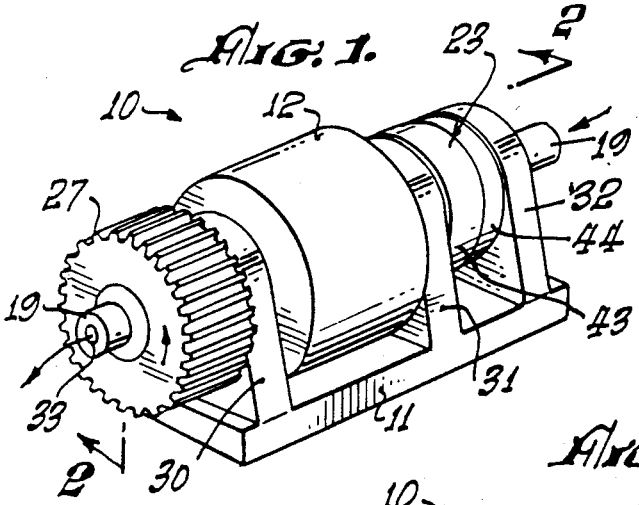
FIG. 4.
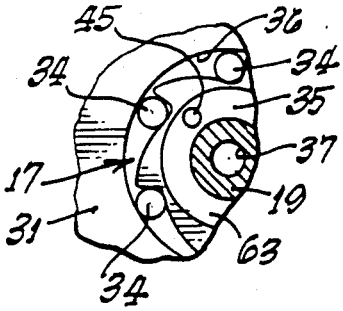
FIG. 2.
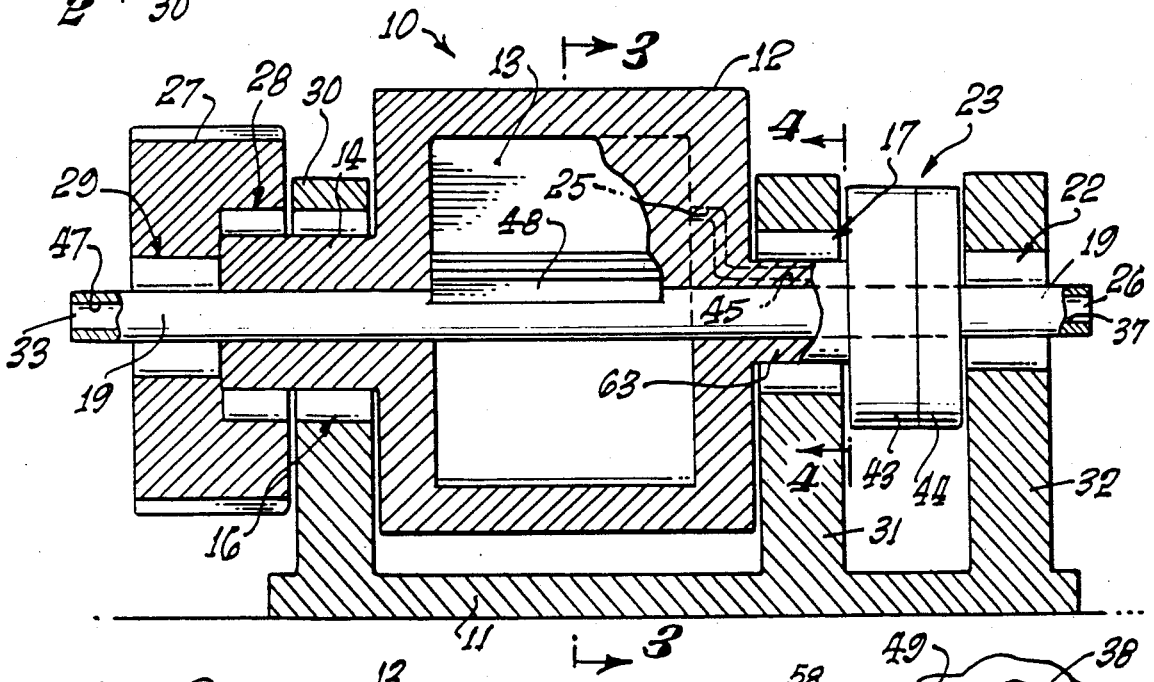
FIG. 3.
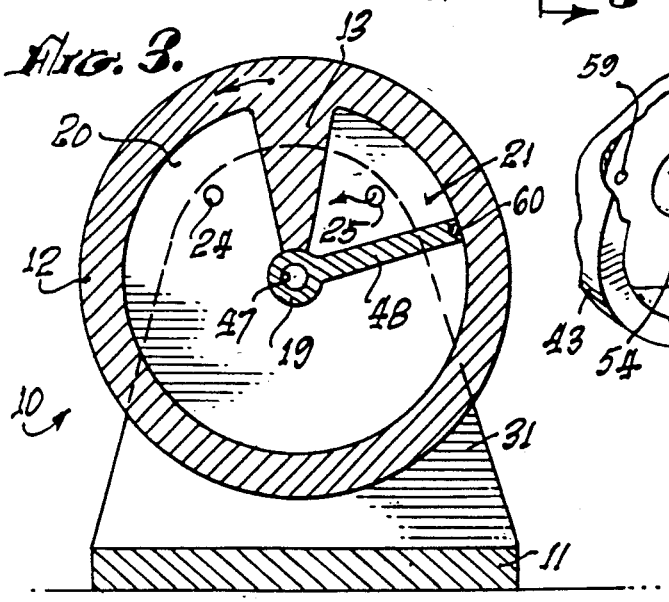
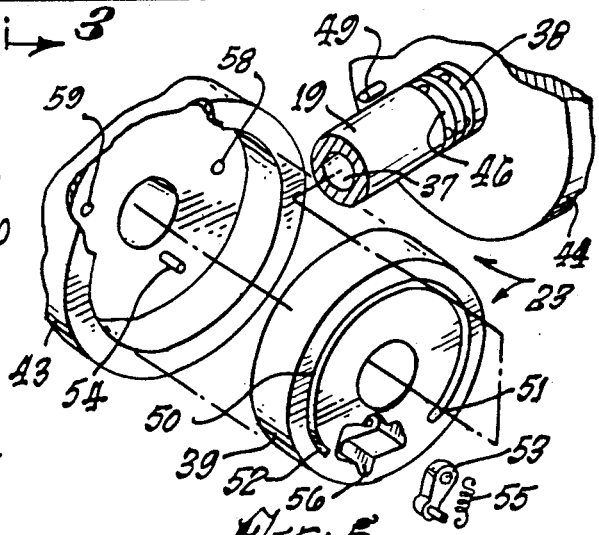
FIG. 5.

ROTATING FLUID DRIVEN ROTARY ACTUATOR

BACKGROUND OF THE DISCLOSURE

The field of the invention is motors and the invention relates more particularly to fluid driven rotary actuators and more particularly to rotary actuators of the type having a vane. Rotary actuators which reciprocate have been widely used for many years. One common application was motor vehicle windshield wiper motors which, of course, could readily use a reciprocating motion. Hydraulically driven reciprocating actuators are used in production line applications such as to turn workpieces and, when hydraulically operated, can provide a large amount of force.

Sliding vane, continuously rotating rotary actuators have also been made which operate with a comparatively low volumetric efficiency, relatively high port to port leakage and have limited low speed capabilities.

It is an object of the present invention to provide a rotary actuator which gives an output in a single direction while at the same time having optimal volumetric and mechanical efficiency.

SUMMARY OF THE INVENTION

The present invention is for a substantially continuously rotating, fluid driven rotary actuator having a base, a rotatable casing having a hollow cylindrical center portion which has a partition member extending radially from the interior surface thereof. The rotatable casing has a first hollow sleeve at an output end thereof, a second hollow sleeve at a valve end thereof and the casing is held by the base through a first bearing affixed to the base and surrounding the first hollow sleeve. The casing is held by a second bearing affixed to the base and surrounding the second hollow sleeve. At least one of the casing-supporting bearings permits rotation in a first direction only. A shaft and vane assembly having a valve end and an output end is held by the rotatable casing and positioned axially therein. The shaft and vane assembly is supported by the first and second hollow sleeves of the rotatable casing and the shaft and vane assembly has a shaft portion which abuts the partition member of the casing and a vane, the terminous of which abuts the interior surface of the center portion of the rotatable casing, creating first and second chambers within the hollow cylindrical center portion. The shaft and vane assembly is held at its valve end by a bearing which permits rotation in a first rotational direction only. Valve means are held by the base and rotate with the rotatable casing providing fluid inlet and outlet to and from the first and second chambers. An output shaft means is supported by an inboard bearing which permits rotation in a second direction only which bearing is held by said first hollow sleeve of said casing and said output shaft also being supported by an outboard bearing which permits rotation in a second direction only which bearing is held by said output end of said shaft portion of the shaft and vane assembly.

BRIEF DESCRIPTION OF THE DRAWINGS

FIG. 1 is a perspective view of the rotary actuator of the present invention.

FIG. 2 is an enlarged cross-sectional view taken along line 2—2 of FIG. 1.

FIG. 3 is a cross-sectional view taken along line 3—3 of FIG. 2.

FIG. 4 is an end view partly in cross-section taken along line 4—4 of FIG. 2.

FIG. 5 is an exploded, perspective view of the valve means of the rotary actuator of FIG. 1.

DESCRIPTION OF THE PREFERRED EMBODIMENTS

Figure 6:
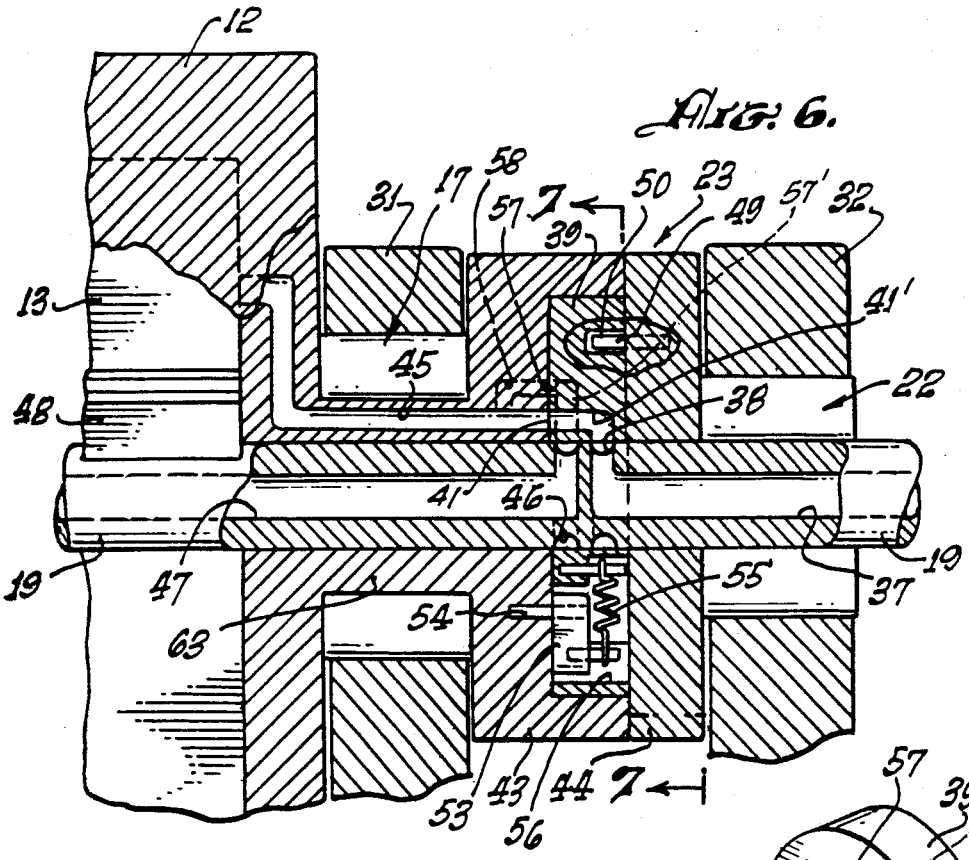
FIG. 6 is a cross-sectional view showing the valve means and a portion of the casing of the rotary actuator of FIG. 1.
Figure 8:
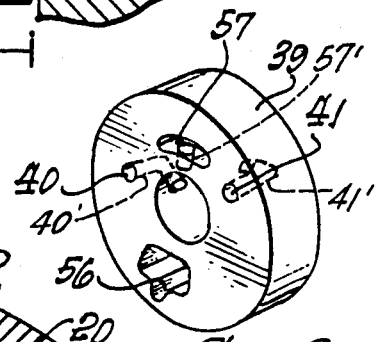
FIG. 8 is a perspective view showing the inboard surface of the central valve member of the actuator of FIG. 1.

The rotary actuator of the present invention is shown in perspective view in FIG. 1 and indicated by reference character 10. The actuator 10 has a base 11 which has three support members 30, 31 and 32. The actuator has three major elements namely an output shaft means 27, a rotatable casing 12 and valve means 23. A shaft 19 passes through the device as more clearly shown in FIG. 2 and has a fluid inlet 26 and a fluid outlet 33. The means for affixing a source of fluid and a return is not shown as such rotating connectors are well known to those skilled in the art. The inlet and outlet is thus shown merely in a schematic manner.

Figure 7:
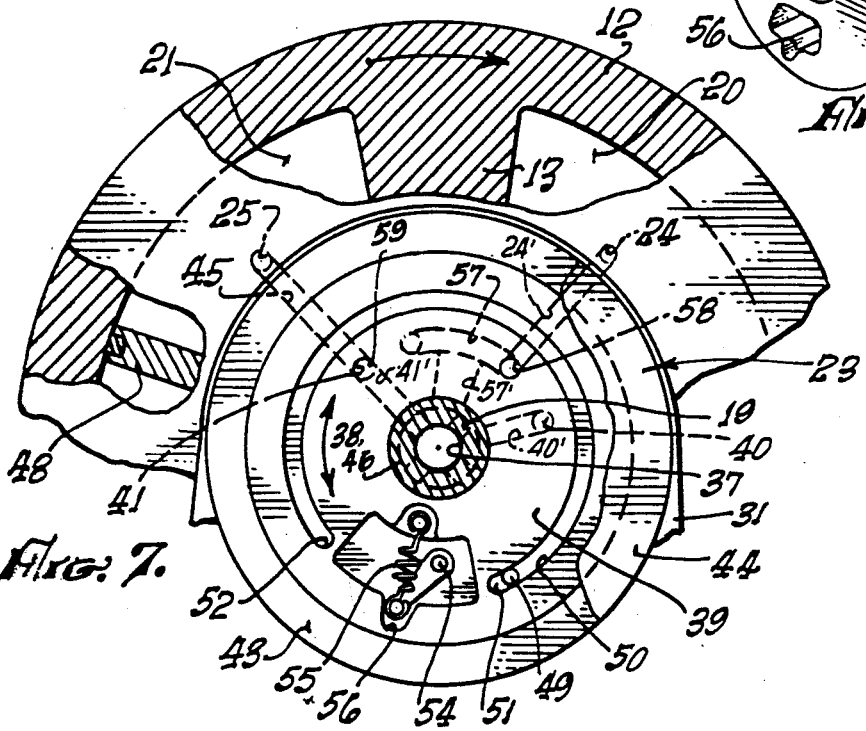
FIG. 7 is an end view partly in cross section and enlarged taken along line 7—7 of FIG. 6.

Further detail is shown in FIG. 2 where shaft 19 is held at one end by a one-way bearing 22 held by support member 32. Many different types of one-way bearings are known and one typical construction is shown in FIG. 4 where a plurality of pins 34 are held between a tooth wheel 35 and a sleeve 36. Bearing 22 also has a conventional portion since it must also support shaft 19 but the conventional portion is not shown as it is believed unnecessary for an understanding of the present invention. As the fluid moves into fluid inlet 26, it passes along an inlet passageway 37 and into an annular groove 38 formed circumferentially around shaft 19 (shown best in FIGS. 5 and 6). Fluid passes from the annular groove into either a first passageway 40,40' (shown in FIG. 7) or a second passageway 41,41' (shown in both FIGS. 6 and 7). These passageways are formed in valve member 39 which is held between inner valve member 43 and outer valve member 44. Outer valve member 44 is keyed or otherwise attached to shaft 19 so that it rotates with shaft 19. Inner valve member 43 is keyed or otherwise attached to hollow sleeve 63 which is integral or otherwise attached to rotatable casing 12. A fluid passageway 25,45,59 acts either to load or unload the second chamber 21 (shown best in FIG. 6) when central member 39 is in the position as shown in FIGS. 6 and 7. The fluid passes into second chamber 21 through fluid passageway 25,45,59. When valve member 39 is in its second position, fluid passes out of fluid passageway 25,45,59 through 57,57' into an annular groove 46 formed around shaft 19 and into outlet passageway 47.

Returning now to FIG. 3, it can be seen that a vane 48 is affixed to shaft 19 and is free to make slightly less than a 360 degree turn with respect to rotatable casing 12. A partition member 13 acts with vane 48 to divide the hollow cylindrical center portion of casing 12 into a first chamber 20 and a second chamber 21. Although not shown, a seal may be located at the end of partition member 13 at the point it contacts shaft 19. Vane 48 may be provided with a seal 60. Fluid passes into and out of the first chamber through the fluid inlet or outlet passageway 24,24',58. Similarly, fluid passes into and out of second chamber 21 through second fluid passageway 25. The movement of vane 48 therefore oscillates with respect to rotatable casing 12 but since casing 12 is itself rotatable and together with the use of one-way bearings, this oscillating and rotational movement is translated into a substantially continuous rotation of output shaft means 27. In other words, for part of its rotation, the output shaft means 27 is moved by the turning of the vane 48 and for the next part of its rotation, it is moved by the turning of the casing 12. A one-way bearing 28 is positioned about second hollow sleeve 14 which is held to base 11 through support 30 and conventional bearing 16. The other end of rotatable casing 12 is similarly held to base 11 through support 31 and one-way second bearing 17. A fourth one-way bearing 29 is positioned between shaft 19 and output shaft means 27. One-way bearings 17, 22, 28 and 29 are similar to that shown in FIG. 4 although other constructions may be used.

Thus, it can be seen that as vane 48 rotates in a clockwise direction as viewed from the fluid input end, the one-way bearing 29 translates that movement into the output shaft means 27. Then as partition member 13 moves clockwise as viewed from the fluid inlet, one-way bearing 22 prevents the shaft from moving in a counter clockwise direction and one-way bearing 28 translates the clockwise movement of the rotatable casing and its partition member 13 into the output shaft means 27. It can thus be seen that a highly efficient use of a fluid pressure differential between the inlet and the outlet results since there is essentially no fluid loss between vane 48 and the interior cylindrical surface of rotatable casing 12.

The valving which directs the fluid into and out of the first and second passageways is shown in FIGS. 5, 6 and 7. A pin 49 is held by outer valve member 44 and moves through groove 50 in central valve member 39. As shown in FIG. 7, pin 49 has touched end 51 and moved central valve member 39 clockwise with respect to inner valve member 43. Pin 49 then moves counter clockwise through groove 50 until it touches end 52 and then moves central valve member 39 counter clockwise with respect to inner valve member 43. Central valve member 39 is prevented from being held in a neutral position by the action of toggle arm 53 which is held by pin 54 in inner valve member 43. A tension spring 55 is affixed to the free end of toggle arm 53 which, in turn, is held in a groove 56 in central valve member 39. It can be seen that when pin 49 abuts end 52 of groove 50, then toggle arm 53 will move to its second position and hold the central valve member 39 in its opposite position. As positioned in FIG. 7, the second inlet fluid passageway 41 is aligned with the fluid passageway 25,45,59 leading to chamber 2 and the fluid from chamber 1 passes through fluid inlet/outlet 24,24',58 in the first chamber into an outlet passageway 57,57' which may be aligned either with fluid passageway leading to chamber 20 or with fluid passageway 25,45,59 leading to chamber 21. As shown in FIGS. 6 and 7, outlet passageway 57 is aligned with fluid passageway 24,24',58. When central valve member 39 is in its second position (not shown), first passageway 40 is aligned with fluid passageway 24,24',58 allowing fluid to pass into chamber 1 and an end of outlet passageway 57,57' is aligned with fluid passageway 25,45,59 leading to and from chamber 2. Passageway 57, 57' is connected to annular groove 46 which, in turn, leads into outlet passageway 47.

The particular valve mechanism shown merely illustrates one method of directing fluid to and from the two chambers. While such system would be very satisfactory with hydraulic fluid, other systems such as electronically controlled valves could be used if a gas or combustible fluid was used.

More than one of the rotary actuators of the present invention may be connected to an output shaft to smooth the movement of the shaft. In addition or alternatively, either the rotatable casing or the inner or outer valve members may be used as a fly wheel to help smooth the output of the actuator of the present invention.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A substantially continuously rotating, fluid driven rotary actuator comprising:

a base;

a rotatable casing having a hollow cylindrical center portion having a partition member extending radially from the interior surface thereof, a first hollow sleeve at an output end thereof, a second hollow sleeve at a valve end thereof, said casing being held by said base by a first bearing affixed to said base and surrounding said first hollow sleeve and by a second bearing affixed to said base and surrounding said second hollow sleeve, at least one of said bearings permitting rotation in a first rotational direction only;

a shaft and vane assembly having a valve end and an output end, said assembly being held by said casing and positioned axially therein and supported by said first and second hollow sleeves, said shaft and vane assembly having a shaft portion which abuts the partition member of said casing and a vane the terminous of which abuts the interior surface of said center portion of the casing creating first and second chambers within said hollow cylindrical center portion, said shaft and vane assembly being held at its valve end by a bearing which permits rotation in a first rotational direction only;

valve means held by said base, said valve means having a first fluid passageway connected to said first chamber of said hollow cylindrical center portion and a second fluid passageway connected to said second chamber thereof, said valve means having a fluid inlet passageway and a fluid outlet passageway; and output shaft means supported by a bearing which permits rotation in a second direction only which bearing is held by said first hollow sleeve of said casing and said output shaft also being supported by a bearing which permits rotation in a second direction only which bearing is held by said output end of said shaft portion of said shaft and vane assembly.

2. The rotary actuator of claim 1 further including liquid hydraulic fluid, filling the inner cavities thereof.

3. The rotary actuator of claim 1 wherein said output shaft means comprises an output gear.

4. The rotary actuator of claim 1 wherein said valve means rotates with said rotatable casing.

5. The rotary actuator of claim 4 wherein said valve means has an inner member which rotates with said shaft and vane assembly.

6. The rotary actuator of claim 5 wherein said valve means has a center disk which rotates with said shaft and vane assembly which disk is free to rotate with respect to said casing and with respect to said shaft and vane assembly.

7. The rotary actuator of claim 6 wherein said disk has pin and groove means affixed between said disk and the portion of said valve means which moves with said shaft and vane assembly.

8. The rotary actuator of claim 1 wherein a fluid conduit is positioned axially along a substantial portion of said shaft of said shaft and vane assembly.

* * * * *